US011976538B2

(12) United States Patent
Fotiades

(10) Patent No.: US 11,976,538 B2
(45) Date of Patent: May 7, 2024

(54) ACID-RESISTANT TOOL FOR OIL OR GAS WELL

(71) Applicant: Revelant IP Holdings LLC, Arvada, CO (US)

(72) Inventor: W. Tracy Fotiades, Friendswood, TX (US)

(73) Assignee: Synergetic Oil Tools, Inc., Calgary (CA)

( * ) Notice: Subject to any disclaimer, the term of this patent is extended or adjusted under 35 U.S.C. 154(b) by 0 days.

(21) Appl. No.: 17/939,720

(22) Filed: Sep. 7, 2022

(65) Prior Publication Data

US 2023/0070942 A1 Mar. 9, 2023

Related U.S. Application Data

(60) Provisional application No. 63/242,399, filed on Sep. 9, 2021.

(51) Int. Cl.
*E21B 43/02* (2006.01)
*E21B 33/128* (2006.01)

(52) U.S. Cl.
CPC ..... *E21B 43/02* (2013.01); *E21B 33/128* (2013.01)

(58) Field of Classification Search
CPC ..... E21B 33/12; E21B 33/10; E21B 33/00; E21B 33/1208; E21B 33/128; E21B 43/02; E21B 43/34; E21B 43/38; B01D 9/00; B01D 9/0063; B01D 9/0068; B01D 9/0081
See application file for complete search history.

(56) References Cited

U.S. PATENT DOCUMENTS 2,330,267 A * 9/1943 Burt ..... E21B 33/14 137/71
2,426,808 A * 9/1947 Gustavus ..... F16K 17/00 220/89.2
2,906,342 A * 9/1959 Roy ..... E21B 43/14 166/115
5,004,366 A * 4/1991 Simmons ..... E01F 9/635 403/2
5,052,491 A * 10/1991 Harms ..... E21B 37/00 210/695
10,502,017 B2 * 12/2019 Marya ..... E21B 33/134
2006/0048941 A1 * 3/2006 Borst ..... E21B 37/00 166/66.5
2011/0308819 A1 * 12/2011 Frazier ..... E21B 33/1204 166/177.5
2013/0269942 A1 * 10/2013 Ellem ..... E21B 33/13 166/67

(Continued)

FOREIGN PATENT DOCUMENTS

AU 2014346622 B2 * 12/2016 ..... E21B 33/12
CN 104302868 A * 1/2015 ..... E21B 23/06

(Continued)

*Primary Examiner* — Daniel P Stephenson
(74) *Attorney, Agent, or Firm* — Greenberg Traurig, LLP

(57) ABSTRACT

Corrosion-resistant tools for use in oil and/or gas wells are described. These tools include at least one component formed of a metal that has a lower density and different physical properties than steel and also a lower resistance to acids in the well environment. The lower density component may be formed of an aluminum alloy and may be shielded by steel components and sealing components of the tool.

18 Claims, 3 Drawing Sheets

(56) References Cited

U.S. PATENT DOCUMENTS

| | | | | |
|---|---|---|---|---|
| 2014/0027108 | A1* | 1/2014 | Lopez | E21B 43/108 166/207 |
| 2015/0354311 | A1* | 12/2015 | Okura | E21B 33/12 175/57 |
| 2018/0320472 | A1* | 11/2018 | Fripp | C22C 21/00 |
| 2019/0128074 | A1* | 5/2019 | Stokes | E21B 33/12 |
| 2019/0224586 | A1* | 7/2019 | Krummel | B01D 9/00 |
| 2022/0034188 | A1* | 2/2022 | Scott, Jr | E21B 33/1208 |
| 2022/0034192 | A1* | 2/2022 | Harris | E21B 23/06 |
| 2023/0070942 | A1* | 3/2023 | Fotiades | E21B 43/02 |

FOREIGN PATENT DOCUMENTS

| | | | | | |
|---|---|---|---|---|---|
| CN | 114427371 | A | * | 5/2022 | |
| WO | WO-2017116407 | A1 | * | 7/2017 | E21B 17/003 |
| WO | WO-2017187117 | A1 | * | 11/2017 | E21B 33/12 |
| WO | WO-2018056966 | A1 | * | 3/2018 | E21B 34/06 |
| WO | WO-2018237314 | A1 | * | 12/2018 | |
| WO | WO-2019194813 | A1 | * | 10/2019 | E21B 23/06 |
| WO | WO-2021043443 | A1 | * | 3/2021 | E21B 33/1208 |

* cited by examiner

ACID-RESISTANT TOOL FOR OIL OR GAS WELL

CROSS-REFERENCE TO RELATED APPLICATION(S)

This application is a nonprovisional application of and claims the benefit of U.S. Provisional Patent Application No. 63/242,399, filed Sep. 9, 2021, and titled "Acid-Resistant Tool for Oil or Gas Well," the disclosure of which is hereby incorporated herein by reference in its entirety.

FIELD

Embodiments described herein relate generally to the use of aluminum and aluminum alloys in oil and gas wells, and more particularly to tools that are used in an oil or gas well and that include aluminum alloy components.

BACKGROUND

Acidizing is one of the most widely used and effective means available for improving productivity and injectivity of oil and gas wells. Acidizing is commonly performed on new wells to enhance initial productivity and/or injectivity and on aging wells to restore productivity or injectivity, as well as increase recovery of hydrocarbon resources (e.g., oil or gas). Acidizing involves pumping acid or acids into wellbores or mineral formations that are capable of producing hydrocarbon resources, optionally along with injecting salt water to carry away the acid.

The mineralogy of the formation type determines the type or types of acid necessary. In carbonate formations, the acid is typically hydrochloric acid (HCl). Acidizing carbonate formations generally dissolves carbonate-based materials to create new or clean existing pathways or channels that allow oil, gas, water, and/or other fluids to flow more freely into the well. In sandstone formations, the acid is typically hydrofluoric acid (HF), which may be used in combination with HCl. Acidizing sandstone formations typically dissolves fine sand (including quartz), feldspar, and/or clay particles that otherwise block or restrict fluid flow through pore spaces, thereby allowing oil, gas, water, and/or other fluids to move more freely into a well bore.

Geologic formations are rarely completely homogeneous but instead contain impurities and can have highly variable compositions. As a result, designing an effective acid treatment can be complex. Most (but not all acid) treatments use blends of HCl and HF given the ubiquity of heterogeneous geologic formations.

Given the prevalence of acids such as HCl and HF in oil and gas wells, tool components made from aluminum or its alloys can be poor choices for oil and gas recovery. Aluminum and aluminum alloys corrode rapidly when exposed to these acids, degrading the life and function of aluminum-based tooling.

SUMMARY

Embodiments described herein take the form of tools for use in oil and/or gas wells (collectively, simply "wells") that are corrosion-resistant and, in particular, acid-resistant, but lighter and with different physical properties than tools made largely from steel. In embodiments, the tool includes a component formed from a metal that has a lower density and different physical properties than steel but is less corrosion-resistant. The tool typically also includes a more corrosion-resistant component that helps to shield the less corrosion-resistant component from acid solutions and/or other corrosive well fluids.

In some cases, a tool incorporates an aluminum alloy component as well as one or more steel components. The aluminum alloy component is generally shielded from exposure to acid solutions and/or other well bore fluids by the steel components. However, the tool may still permit flow of well bore fluids or the like through or past the aluminum alloy components. Thus, the aluminum alloy components may reduce weight and contribute certain functionality without degrading under operating conditions, particularly when a well is acidized.

The present disclosure is applicable to a variety of tools. In some cases, the tool is capable of treating well fluids flowing along a fluid flow path defined by the tool. For example, the tool may include a band-pass filter component that is formed from a metal that is less corrosion-resistant than steel components of the tool. The band-pass filter component may encircle the fluid flow path without contacting the fluids flowing along the path. In additional cases, the tool includes a shear screw that is formed from a metal that is less corrosion-resistant metal than steel components of the tool. For example, the tool may be a compression set tool such as an isolation packer.

One embodiment takes the form of a tool for use in an oil or gas well, comprising: a body made from a first metal; a mandrel made from the first metal and affixed to the body; a component made from a second metal and positioned between the body and mandrel; and a seal positioned between the body and mandrel; wherein: the seal, body, and mandrel cooperate to isolate the component from a fluid outside the tool; and at least one of the body or mandrel defines a fluid flow path through the tool.

Another embodiment takes the form of a tool for use in an oil or gas well, comprising: a steel mandrel defining a through-hole of the tool; an aluminum alloy component partially surrounding the steel mandrel; a steel body partially surrounding the aluminum alloy component; an upper seal formed at an upper joint between the steel mandrel and the steel body; and a lower seal formed at a lower joint between the steel mandrel and the steel body, wherein the upper seal, the lower seal, the steel mandrel and the steel body together isolate the aluminum alloy component from a fluid outside the tool.

An additional embodiment takes the form of a tool for use in an oil or gas well, comprising: a steel mandrel partially defining a through-hole of the tool; a steel body at least partially surrounding and coupled to the steel mandrel; an aluminum alloy component positioned between the steel body and the steel mandrel; a first seal and a second seal that cooperate with the steel mandrel and the steel body to shield the aluminum alloy component from a fluid outside the tool; and a third seal defining a portion of an exterior surface of the tool.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
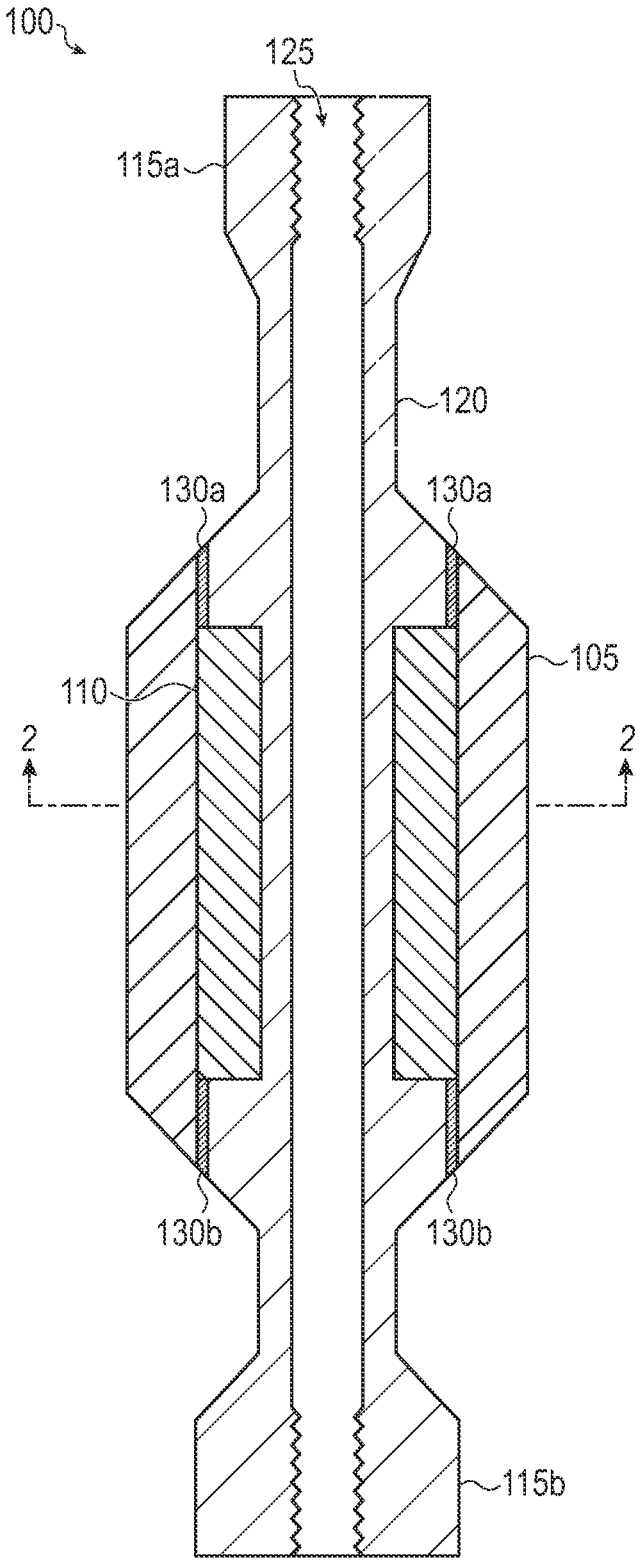
FIG. 1 shows a first cross-section of a first example tool.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Generally, tools for use in oil and/or gas wells are made wholly or largely from steel (and, in many cases, carbon steel) or other corrosion-resistant metals. While this can prevent or reduce pitting, corrosion, and/or structural weakening of the tools while operating within a well, it can also increase the weight (and thus awkwardness) of such tools. Steel is an especially common tooling material in wells that are acidized, e.g., in which acid solutions are pumped to increase well yield, as the acid is itself highly corrosive.

Aluminum, unfortunately, generally reacts rapidly with hydrochloric and/or hydrofluoric acid. For example, aluminum reacts with hydrochloric acid to produce aqueous aluminum chloride (e.g., $AlCl_3$) and hydrogen gas (e.g., $H_2$). Generally, this reaction is described by the following equation (Equation 1):

$$2Al+6HCl=2AlCl_3+3H_2\uparrow \quad \text{Equation 1}$$

Similarly, aluminum reacts with hydrofluoric acid to produce aluminum fluoride (e.g., $AlF_3$) and hydrogen (e.g., $H_2$). This reaction is shown in the following equation (Equation 2):

$$2Al+6HF=2AlF_3+3H_2\uparrow \quad \text{Equation 2}$$

Embodiments described herein take the form of tools for use in oil and/or gas wells (collectively, simply "wells") that are corrosion-resistant and, in particular, acid-resistant, but lighter and with different physical properties than tools formed largely or wholly from steel. Such embodiments incorporate aluminum alloy components as well as steel components. The aluminum alloy components are generally shielded from exposure to acid solutions and/or other well bore fluids by the steel components, but still may permit flow of well bore fluids or the like through or past the aluminum alloy components. Thus, the aluminum alloy components may reduce weight and contribute certain functionality without degrading under operating conditions, particularly when a well is acidized.

The tools described herein may utilize components formed from an aluminum alloy rather than pure aluminum. For example, one suitable alloy contains approximately 4.5%-6.0% silicon, 0.6-1.0% iron, 2.5%-3.5% copper, 0.04-0.08% manganese, 0.2-0.4% magnesium, 3.0-4.5% zinc, 1.0-3.0% titanium, and a balance of aluminum (by weight). A particularly suitable alloy is formed from, again by weight, 4.5-6.0% silicon, 0.8% iron, 2.5%-3.5% copper, 0.06% manganese, 0.2-0.4% magnesium, 3.0-4.5% zinc, 2.0% titanium, and a balance of aluminum. Such alloys have yield strengths of approximately 20,000-30,000 PSI and a Brinell hardness of about 75. These alloys have sufficient yield strength and hardness to function in the environment typically found at depths of a well. Additionally, although particular values, percentages, and functional characteristics are provided for certain alloys, it should be understood that these values, percentages, and characteristics are examples rather than limitations.

Figure 2:
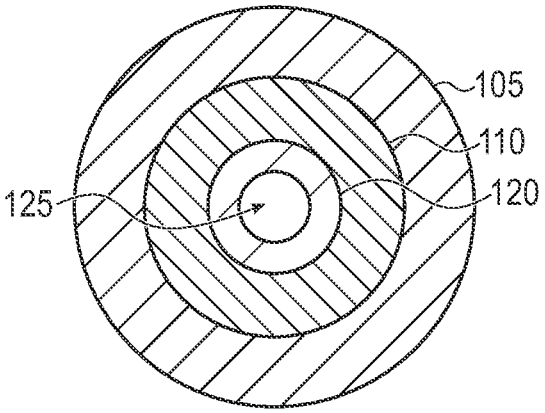
FIG. 2 shows a second cross-section of the first example tool.

FIG. 1 is a first cross-section of a first sample tool, namely a band-pass filter assembly, for use in an oil or gas well. FIG. 2 is a second cross-section of the first sample tool shown in FIG. 1, taken along line 2-2 of FIG. 1. The tool 100 includes a body 105 (made from a steel or another suitable material, such as another corrosion-resistant metal), a mandrel 120 (made from steel or another suitable material, such as another corrosion-resistant metal), a component 110 (made from an aluminum alloy or a component made from another suitable material which is less corrosion resistant than the body 105 and the mandrel 120), seals 130A and 130B, and two end connections 115A and 115B.

In some embodiments, the component 110 is an aluminum alloy component that is capable of converting a passive energy source to a spectral energy pattern tuned to be resonant with different types of molecular oscillations pertinent to oil and/or water. The aluminum alloy component may therefore be referred to as a band-pass filter. Tuned energy patterns may convert problematic insoluble crystals to more thermodynamically stable and soluble crystals. The component 110 may at least partially surround or encircle the mandrel 120 and may be capable of treating well fluid in the presence of the steel mandrel. In other words, the component 110 may be capable of transmitting the spectral energy pattern into a through-hole of the tool defined by the steel mandrel. Therefore, the tool 100 may operate to guide or control crystal polymorphism in oil and water flowing though the through-hole of the tool, and particularly in such fluids within a well, as detailed in U.S. application Ser. No. 16/317,490, published as U.S. Patent Pub. No. 2019/0224586, and related applications. Accordingly, the operation of the band-pass filter is not described herein in greater detail.

In embodiments, the body 105 is a steel body and the mandrel 120 is a steel mandrel. The steel body and the steel mandrel may be made from at least one of a carbon steel, a low alloy steel, or a stainless steel. The stainless steel may be a martensitic stainless steel, an austenitic stainless steel, or a duplex stainless steel. When the steel is a carbon steel or a low alloy steel, the improved corrosion resistance of the steel as compared to aluminum may be due in part to the addition of one or more well additives tailored to protect carbon steel and/or low alloy steel components. Other suitable corrosion-resistant materials for the body 105 and the mandrel 120 include, but are not limited to, nickel alloys.

The body 105 at least partially surrounds the mandrel 120 and the component 110 in the example of FIG. 1. As shown in FIG. 2, the body 105 encircles the mandrel 120. The body 105 may be attached to the mandrel 120 with intervening seals 130A, 130B positioned at the joints. The seal 130A of FIG. 1 is an upper seal formed at an upper joint between the body 105 and the mandrel 120 and the seal 130B is a lower seal formed at a lower joint. Unlike some conventional band-pass filter assemblies, the seals 130A and 130B of the tool 100 prevent acid or other liquids from entering the body 105 and contacting the internal component 110 or other internal component formed from an aluminum alloy. The seals 130A and 130B may include, but are not limited to, at least one of an elastomeric seal, a welded seal, a thermoplastic seals, or a metal-to-metal seal.

By forming the body 105 and mandrel 120 from two separate metal sections, the aluminum alloy component may be placed within the body 105 during assembly rather than requiring the body to be formed around the component 110. The body 105 and mandrel 120 may be threadedly connected, soldered, welded, adhered, or otherwise removably or irremovably joined to one another. This creates an internal cavity or void in which the component 110 resides, thus shielding it from corrosive liquid in the environment and protecting the component 110. As shown in the example of FIG. 1, an exterior surface of the mandrel 120 defines a recess and the component 110 is positioned within the recess.

The mandrel 120 defines a through-hole 125, along which liquid may flow to exit the well. This through-hole 125 extends along the length of the mandrel 120. As shown in the example of FIG. 2, the component 110 defines an internal bore, and the mandrel is positioned within the internal bore. Therefore, the through-hole 125 passes through the internal bore of the component 110 (e.g., the band-pass filter) without permitting any corrosive material (such as acid or acid-containing fluid) flowing through the through-hole 125 to contact the component 110. The component 110 may operate on liquid flowing through the through-hole 125 to guide or control polymorphism in oil and/or water without directly contacting the liquid.

End connections 115A, 115B are formed at either end of the mandrel 120 and permit the overall tool 100 to be connected to a pipe, reciprocating pump, or other element in order for the tool to move along the well and/or operate. End connections 115A, 115B may be integral with the mandrel and formed from the body of the mandrel 120 or may be separate elements affixed to the mandrel. As shown in FIG. 1, the end connection 115A is an upper end connection and the end connection 115B is a lower end connection.

Figure 3:
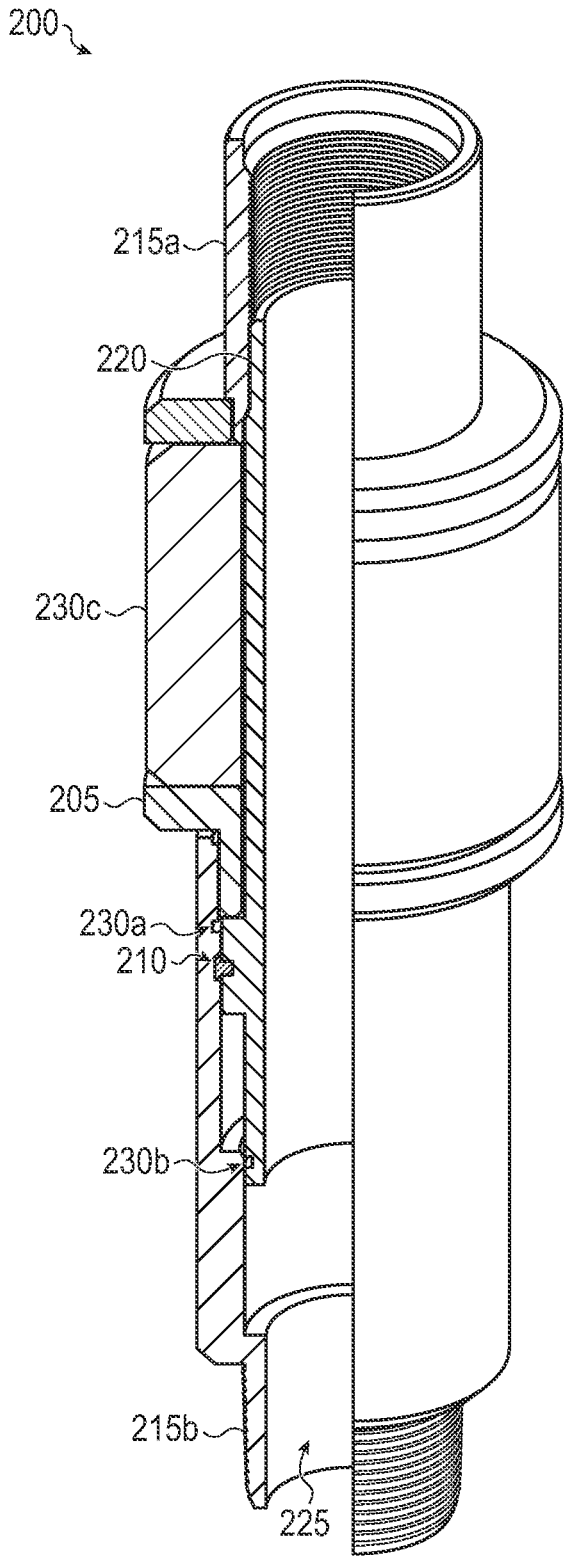
FIG. 3 shows a cross-section of a second example tool.

FIG. 3 illustrates a cross-section of a second sample tool 200, here taking the form of an isolation packer for use in an oil or gas well. As with the tool 100 shown in FIGS. 1-2, the tool 200 includes a body 205, a component 210, two end connections 215A, 215B, and a mandrel 220. The tool 200 further includes two seals 230A, 230B that cooperate to isolate the component 210 from fluids, as well as a third seal 230C that seals a volume within a casing or a tube (not shown) in which the tool 200 is positioned and/or travels. The third seal 230C defines a portion of the exterior surface of the tool as shown in FIG. 3.

The component 210 may be positioned between the body 205 and the mandrel 220 and in some cases may act as a reversible coupling component between the body 205 and the mandrel 220. For example, the component 210 may be a shear screw that couples the body 205 and the mandrel 220 when the shear screw is intact and no longer couples the body 205 and the mandrel 220 when the shear screw breaks. The component 210 may be an aluminum alloy component and may be formed from a similar aluminum alloy or a different aluminum alloy than the component 110.

The body 205, end connections 215A, 215B, and mandrel 220 are generally formed of similar materials as discussed above with respect to the body 105, the end connections 115A, 115B, and mandrel 120 of FIGS. 1-2. For example, the body 205 may be a steel body and the mandrel 220 may be a steel mandrel. The body 205 may be reversibly or permanently coupled to the mandrel 220. In some cases, the body 205 may contain both movable and stationary portions, as described in more detail below. The end connections 215A and 215B may generally perform similar functions as previously discussed with respect to the end connections 115A, 115B.

Isolation packers such as tool 200 are compression set tools and serve to isolate casings or perforations, such as holes in a tube within the well. Isolation packers provide a flow path for fluid and/or gas to exit a well through a tube while bypassing such perforations, casings, or components. The body 205, mandrel 220, and end connections 215A, 215B cooperate to define a through-hole 225 along which fluid can flow. Two isolation packers may cooperate to isolate a section of a well, tube, or the like that is to be bypassed; the third seal 230C expands under compression to contact the casing of the well or the tube walls, preventing fluid from flowing past the third seal except through the through-hole 225. Thus, two isolation packers affixed to one another by their end connections can cooperate to isolate sections of a casing, tube, or other component located between the packers' seals 230C.

When the isolation packer 200 is compressed, the component 210 (here, a shear screw) shears and allows the mandrel 220 to move relative to at least some portions of the body 205. For example, the mandrel 220 may move upwards in the tool. This, in turn, may cause a portion of the body 205 move upwards and compress the third seal 230C, causing the third seal 230C to engage with the wall of the casing or tube. The mandrel 220 may be affixed to the body 205 prior to shearing of the component 210 and then slidably coupled to lower portions of the body 205 after the component 210 has broken by shearing. Other portions of the body 205 may remain stationary while the mandrel 220 slides upward within the tool.

Thus, the isolation packer 200 does not operate effectively unless the component 210 is able to shear in response to compression. However, if the component 210 is exposed to acid or other corrosive material within the well, it may fail prematurely and render the isolation packer 200 inoperable. Accordingly, the mandrel 220 and body 205 cooperate to protect the component 210 from such fluids and the seals 230A, 230B prevent fluid from entering through the joint between the mandrel 220 and body 205. In this manner, the component 210 is environmentally protected by other components of the tool 200.

Thus, a component 210 made from an aluminum or aluminum alloy can be used instead of a shear screw made from a corrosion-resistant material. Aluminum may shear or deform more easily than steel or another type of corrosion-resistant metal, again making it ideal for use in the component 210.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not intended to be exhaustive or to limit the embodiments to the precise forms disclosed. It will be apparent to one of ordinary skill in the art that many modifications and variations are possible in view of the above teachings.

I claim:

1. A tool for use in an oil or gas well, comprising:

a body made from a first metal;

a mandrel made from the first metal and affixed to the body, the mandrel having an exterior surface that defines a recess;

a component made from a second metal and positioned within the recess defined by the exterior surface of the mandrel such that component is disposed between the body and the mandrel; and a seal positioned between the body and the mandrel; wherein:

the seal, the body, and the mandrel cooperate to isolate the component from a fluid outside the tool; and at least one of the body or the mandrel defines a fluid flow path through the tool.

2. The tool of claim 1, wherein:

the first metal is a carbon steel; and the second metal is an aluminum alloy.

3. The tool of claim 2, wherein:

the mandrel defines a through-hole;

the fluid flow path extends through the through-hole; and the body at least partially surrounds the mandrel.

4. The tool of claim 3, wherein the component encircles the mandrel.

5. The tool of claim 4, wherein the component is a band-pass filter.

6. The tool of claim 1, wherein the mandrel is removably affixed to the body.

7. A tool for use in an oil or gas well, comprising:

a steel mandrel defining a through-hole of the tool, the steel mandrel having an exterior surface that defines a recess;

an aluminum alloy component partially surrounding the steel mandrel and positioned within the recess defined by the exterior surface of the mandrel;

a steel body partially surrounding the aluminum alloy component;

an upper seal formed at an upper joint between the steel mandrel and the steel body; and a lower seal formed at a lower joint between the steel mandrel and the steel body, wherein the upper seal, the lower seal, the steel mandrel, and the steel body together isolate the aluminum alloy component from a fluid outside the tool.

8. The tool of claim 7, wherein:

the steel body and the steel mandrel together define an internal cavity of the tool; and the aluminum alloy component is positioned within the internal cavity.

9. The tool of claim 7, wherein the tool defines a fluid flow path through the through-hole.

10. The tool of claim 9, wherein the aluminum alloy component is capable of converting a passive energy source to a spectral energy pattern tuned for oil and transmitting the spectral energy pattern into the through-hole.

11. The tool of claim 7, wherein each of the upper seal and the lower seal is an elastomeric seal.

12. The tool of claim 7, wherein each of the upper seal and the lower seal is a weld between the steel mandrel and the steel body.

13. The tool of claim 7, wherein the steel mandrel further defines an upper end connection and a lower end connection.

14. A tool for use in an oil or gas well, comprising:

a steel mandrel partially defining a first portion of a through-hole of the tool;

a steel body at least partially surrounding and coupled to the steel mandrel, the steel body defining a second portion of the through-hole of the tool;

an aluminum alloy component positioned between the steel body and the steel mandrel;

a first seal and a second seal that cooperate with the steel mandrel and the steel body to shield the aluminum alloy component from a fluid outside the tool; and a third seal defining a portion of an exterior surface of the tool.

15. The tool of claim 14, wherein the aluminum alloy component is a shear screw.

16. The tool of claim 15, wherein:

shearing of the shear screw allows the steel mandrel to slide within the steel body; and a portion of the steel body causes the third seal to engage with a casing of the oil or gas well in response to the sliding of the steel mandrel.

17. The tool of claim 16, wherein:

the portion of the steel body is a first portion of the steel body;

a second portion of the steel body and the steel mandrel cooperate to define an internal cavity of the tool; and the aluminum alloy component is positioned within the internal cavity.

18. The tool of claim 14, wherein the tool defines a flow path through the through-hole.

* * * * *